US007765657B2

(12) United States Patent
Pavlov

(10) Patent No.: US 7,765,657 B2
(45) Date of Patent: Aug. 3, 2010

(54) SYSTEM FOR FORMING BARBED TAPE PRODUCT

(76) Inventor: Michael V. Pavlov, Route 32, P.O. Box 209, Bloomington, NY (US) 12411

( * ) Notice: Subject to any disclaimer, the term of this patent is extended or adjusted under 35 U.S.C. 154(b) by 0 days.

(21) Appl. No.: 12/467,025

(22) Filed: May 15, 2009

(65) Prior Publication Data

US 2009/0223590 A1 Sep. 10, 2009

Related U.S. Application Data

(62) Division of application No. 11/778,846, filed on Jul. 17, 2007, now Pat. No. 7,549,203, and a division of application No. 10/959,944, filed on Oct. 5, 2004, now Pat. No. 7,353,576.

(60) Provisional application No. 60/589,668, filed on Jul. 19, 2004.

(51) Int. Cl.
*B21F 25/00* (2006.01)

(52) U.S. Cl. ..... 29/7.1; 140/1

(58) Field of Classification Search ..... 29/7.1, 29/432, 566; 242/397; 140/58, 1; 256/1.2, 256/8.6

See application file for complete search history.

(56) References Cited

U.S. PATENT DOCUMENTS 7,549,203 B2 * 6/2009 Pavlov ..... 29/7.1

* cited by examiner

*Primary Examiner*—John C Hong
(74) *Attorney, Agent, or Firm*—Schmeiser, Olsen & Watts LLP

(57) ABSTRACT

A system and method for producing a barbed taped product is controlled by an electronic controller to provide a predetermined pattern of attachment points. The system automatically clips adjacent loops of product strands together in the predetermined pattern. The system is capable of varying the pattern from roll to roll, within a given roll, and between rolls. The system and method eliminates the need for ceasing production between rolls in order to re-thread.

12 Claims, 8 Drawing Sheets

SYSTEM FOR FORMING BARBED TAPE PRODUCT

This application is a divisional of U.S. patent application Ser. No. 11/778,846, filed on Jul. 17, 2007, entitled "SYSTEM AND METHODS FOR FORMING BARBED TAPE PRODUCT", which is a divisional of U.S. patent application Ser. No. 10/959,944, filed on Oct. 5, 2004, entitled "SYSTEM AND METHODS FOR FORMING BARBED TAPE PRODUCT", which also claims the benefit of U.S. Provisional Patent Application Ser. No. 60/589,668, entitled RAPID DEPLOYMENT BARBED TAPE AND DISPENSER, by the same inventor, filed Jul. 19, 2004. The disclosure of these related applications are incorporated herein by this reference.

BACKGROUND OF THE INVENTION

1. Technical Field

This invention generally relates to machines for forming barbed tape products, and more particularly to a system and method for automatically forming barbed tape concertina product.

2. State of the Art

Barbed tape products are known. Much of the process of making such products has been automated. For example, forming the barbs from a stock tape material has been automated. Also, placement of a reinforcing wire within a channel formed in the tape has been automated. Bending of the product into round coils is also part of known production processes. Efforts to automatically and efficiently clip adjacent strands of product together have been unsuccessful. Accordingly, most manufacturers rely upon manually attaching adjacent strands of the product in a concertina or other desired pattern. Most concertina products have three attachment elements for every two winds (or loops) of the product strand. These elements are generally placed at equally spaced circumferential positions along the product strand. Known barbed tape products seldom purposely depart from this pattern except for between rolls when attaching is suspended, the strand is severed, and the machine is re-threaded for a subsequent roll of product.

Attachment elements, which are generally U-shaped clips with arms that extend from a base and surround a pair of strands are known. In these clips, the arms interleave with each other in an attached configuration. These clips are attached with a clip gun that is typically actuated by a human operator. For convenience, multiple clips are held together in a string by a pair of filaments. The string of clips is fed into the clip gun so that the clip gun may be actuated repeatedly.

DISCLOSURE OF THE INVENTION

The present invention relates to a system and method of forming a barbed tape product. The method may advantageously include programming an electronic controller for automatically forming, coiling and attaching loops and pairs of loops of the product together. In particular, the method includes programming the controller for automatically forming a strand of the product in a machine. The controller is also programmed to coil the strand of product into loops of a predetermined radius and to attach adjacent loops of the product together at predetermined attachment points along the strand of product. The method includes operating the machine under control of the electronic controller to complete the operational steps of forming, coiling, and attaching the strand of product.

The step of attaching may include connecting a first pair of adjacent loops together by a clip at a first predetermined circumferential position on the coils and connecting a second pair of adjacent loops together by a clip at a second predetermined circumferential position on the coils circumferentially spaced from the first position. The first pair of loops may be adjacent to the second pair of loops. The method may further include the step of connecting individual adjacent loops together by at least one additional clip in at least one helically progressive circumferential position between the first position and the second position. Alternatively, the method may include the step of connecting the individual adjacent loops together by a plurality of additional clips between the first position and the second position in a helically progressive pattern.

In accordance with the method, the strand of product may form a coil having a first predetermined length comprising a plurality of adjacent loops. The step of programming for automatically attaching may include programming the electronic controller for attaching in a predetermined pattern of attachment points along the strand of product. Furthermore, the step of operating the machine to complete the operational step of attaching may include connecting adjacent loops together by clips at predetermined helically progressive circumferential positions in accordance with the predetermined pattern.

While the present method implemented to form a concertina product will typically involve attaching adjacent loops of directly together by clipping, a method of forming a barbed tape product of the present invention may also include forming non-concertina products. This is done by similarly programming an electronic controller for automatically connecting adjacent loops together at predetermined positions along the strand of product and by operating the machine under electronic controller control to connect a first loop to a second loop by a spacer line. It is to be understood that the spacer line may be a wire or a ribbon, for example. This line may be formed of any of a variety of materials including, but not limited to cables or extrusions of plastics, metals, and/or fabric. The first and second loops may be connected to each other by attaching the spacer line to a first attachment point at a first predetermined circumferential position on the first loop and attaching the spacer line to a second attachment point at a second predetermined circumferential position on the second loop. Thus, the first and second loops may form at least a portion of the coil, and the first and second attachment points may be circumferentially spaced from each other on the coil. The first loop may be adjacent to the second loop, or the first and second loops may have intervening loops therebetween.

The method may further comprise the steps of connecting the adjacent loops to each other by one or more additional spacer lines attached to additional respective first and second attachment points on the first and second loops in helically progressive circumferential positions on the loops. As described above, the first and second attachment points of the first loop may be circumferentially offset relative to the first and second attachment points of the second loop.

In a simple form the method of forming a barbed tape product may include forming the product into a helical coil and automatically attaching at least one object to a strand of the coil under the control of an electronic controller. The method may further include automatically attaching a plurality of objects to the strand of the coil. The plurality of objects may include a plurality of similar objects and/or a plurality of dissimilar objects. These objects may include a plurality of lines.

The method may further include automatically attaching the plurality of lines at a plurality of attachment points on at least one loop of the coil. The method may also include attaching each of the plurality of lines to the plurality of loops at the plurality of attachment points on the plurality of loops of the coil. The step of attaching each of the plurality of lines at the plurality of attachment points may include attaching each of the plurality of lines to the plurality of loops at circumferentially spaced locations on the coil. Furthermore, the method may further include attaching the plurality of lines at a first set of attachment points on a first length of the coil and attaching the plurality of lines at a second set of attachment points on a second length of the coil so that the second set of attachment points is offset relative to the first set of attachment points. For a roll of barbed tape product, the method may include alternatingly attaching the plurality of lines at respective first sets of attachment points on a plurality of first lengths and at respective second sets of attachment points on a plurality of second lengths, and alternating the first and second lengths in a helically progressive pattern along the strand of the coil.

The step of attaching the plurality of objects may include attaching at least one fastener and at least one line. The line may be one or more of each of a spacer line, a trip line, and/or a sensor line. The step of attaching a plurality of objects may additionally or alternatively include attaching at least one marker. The step of attaching a plurality of objects may include attaching at least one clip. It is to be understood that the lines and other objects may be attached by clips or other fastening mechanisms. These fastening mechanisms may include an integral structure of the objects themselves.

The step of attaching the plurality of objects may include attaching the plurality of objects by a single device attached to a take up reel. Alternatively, the step of attaching the plurality of objects may include attaching the plurality of objects by a plurality of devices attached to a take up reel. The step of attaching the plurality of objects may include attaching at least one of the objects inside the coil and/or another of the objects outside the coil. The step of attaching the plurality of objects may also include attaching a first set of objects in a first pattern and a second set of objects in a second pattern. In fact, any number of different or similar patterns may be applied to any number of objects to be attached to the coil generally simultaneously. It is to be understood that the patterns may be adjusted to provide attachment of the various objects in a simultaneous or a sequential manner.

A machine for automatically making a barbed tape product in accordance with the present invention may include an electronic controller operatively connected to an attachment device in the machine for automatically attaching at least one object to at least one predetermined position on the barbed tape product under electronic control to form a roll of the barbed tape product. The object may be a clip or other fastener for merely attaching one loop of the product to another. In a simple form, the machine may automatically make barbed tape by an attachment device and electronic controller that are configured to variably attach the at least one object to the barbed tape product at a predetermined attachment point corresponding to a predetermined position under electronic control.

The machine for automatically making barbed tape may be configured to attach a plurality of objects to the barbed tape product. In this regard, the machine and the electronic controller may be configured to provide a first set of the attachment points for the plurality of objects in a predetermined first pattern for a first roll of the product and a second set of the attachment points for the plurality of objects in a predetermined second pattern for a second roll of the product. The patterns may be selectively varied from the first set to the second set.

The machine for automatically making barbed tape may be configured for attaching the plurality of similar or dissimilar objects. The attachment device may have a plurality of attachment mechanisms configured for respectively attaching the plurality of objects to the barbed tape product. The electronic controller may be configured to provide a first set of attachment points for a first attachment mechanism of the attachment device and a second set of attachment points for a second attachment mechanism of the attachment device. On the other hand, the attachment device may be a first attachment device and the machine may further include at least a second attachment device configured for attaching respective first and second objects of the plurality of objects. It is to be understood that the first and second attachment devices may be similar or dissimilar devices and may be configured for attaching similar or dissimilar objects. Furthermore, any number of additional attachment devices may be provided for attaching additional similar or dissimilar objects to the barbed tape product under control of the electronic controller. Still further, the electronic controller may be configured to provide a first set of attachment points for a first attachment device and a second set of attachment points for the second attachment device. Alternatively or additionally, the electronic controller may be configured to provide respective sets of the attachment points for attaching the plurality of objects in predetermined patterns for a roll of the product. The respective patterns may be varied within the roll.

The resulting products and the attachment elements used in forming such products are the subject of a U.S. patent application Ser. No. 10/959,531 by the same Applicant as this Application, entitled "BARBED TAPE PRODUCT WITH A PREDETERMINED PATTERN OF ATTACHMENT POINTS AND ATTACHMENT ELEMENTS", filed Oct. 5, 2004, the disclosure of which is incorporated herein by reference.

Advantageously, the step of attaching the product may include automatically connecting loops of the product at a rate of approximately 125 attachment points in 320 seconds or less in some cases. On the other hand, the step of attaching the product may comprise automatically connecting loops of the product at a rate of approximately 125 attachment points in 300 seconds or less in other cases. In still other cases, the step of attaching the product may be implemented at an even faster rate in which the machine automatically connects loops of the product at a rate of approximately 125 attachment points in 240 seconds or less. All of these rates are an improvement over the fastest rates in the rest of the industry. Most of the industry relies upon manually attaching or clipping and believes that manual clipping is faster than automatic clipping. However, with the present invention, the above rates may advantageously enable greater efficiency in producing barbed tape concertina and other barbed tape products. Furthermore, the automation of the present invention lays the groundwork for unmanned production. That is, with the current method and system, product could be manufactured during lights out time, as well as during the day. Thus, production can be increased and efficiency can be increased simultaneously.

Still further, with the present invention, the attachment points on adjacent pairs of loops are offset relative to each other. Thus, mis-clipping has been greatly reduced or eliminated. The present system and method has eliminated the need for a person to use his or her finger to separate coils of adjacent pairs of loops for clipping. Rather, the coils are separated just the right distance by a previously attached clip that is in a closest axial position, but which is offset slightly in a circumferential direction.

With the present invention, any pattern of attaching may be implemented, and it is contemplated that any naturally lying deployed configuration of the finished barbed tape product could be provided by a corresponding attaching pattern. An advantage of providing a deployed configuration by the pattern reduces waste and facilitates the deploying process. Shapes such as donuts, letters, or even words could feasibly be provided by corresponding patterns of attaching. Attaching patterns providing deployed configurations other than generally straight line configurations with and without automation were non-existent and non-obvious prior to the present disclosure. Patterns including those providing generally straight configurations by the present automated method were also non-obvious prior to the present disclosure because the industry held that manual or hand clipping was faster and more efficient than the automation available in the industry prior to this invention.

The method of the present invention may include a step of selecting attachment point placement. This step of selecting attachment point placement may include selecting at least one frequency of the attachment point placement. The step of selecting the attachment point placement may further include selecting a plurality of frequencies for the attachment point placement. The step of selecting the attachment point placement may also include forming a dead space. This may be accomplished by changing a pattern of the attachment point placement or by skipping at least one unit in the frequency of the attachment point placement. Units in the attachment point placement frequency may be defined as one or more intervals and/or fractions of intervals, wherein an interval corresponds to a distance between adjacent sets of barbs on a strand of the product.

It is to be understood that the step of selecting attachment point placement may include a preliminary step of preprogramming the electronic controller to automatically place the attachment points. In fact, the method of forming a barbed tape product may simply include programming an electronic controller for automatically attaching adjacent loops of the product together in a predetermined pattern of positions along a strand of the product.

Advantageously, the step of programming may include programming the electronic controller to automatically vary the pattern of positions from a first roll of the product to a second roll of the product. As such, the method may also include automatically forming at least the first and the second rolls of the product and varying the pattern from the first roll of the product to the second roll of the product. Alternatively or additionally, the step of programming may further include programming the electronic controller to automatically vary the pattern of positions within a particular roll of the product and automatically forming the roll and varying the pattern within the roll under electronic control. Still further, the step of programming may alternatively or additionally include programming the electronic controller to automatically vary the pattern of positions between respective ones of a plurality of rolls. It is to be understood that varying the pattern between rolls may include suspending attachment for a predetermined length of a strand of the product. In any case, the method may include automatically forming the plurality of rolls and varying the pattern for the length of the product between the respective rolls.

The present invention also includes a machine or system of machines for automatically making barbed tape product. The machine or system may advantageously include at least one roll former, a radial bender, a take up device, an attaching device, and/or an electronic controller. The attaching device may be configured to automatically attach adjacent loops of product together at predetermined attachment points. The electronic controller may be programmed or configured to provide a first set of attachment points in a predetermined pattern for a first roll of product. The pattern may be varied between the first set and a second set of attachment points corresponding to a second roll. As may be appreciated, the pattern may be varied from the first set to the second set by programming the electronic controller accordingly. Alternatively or additionally, the pattern may be varied for short periods between sets to advantageously reduce or eliminate the need to rethread the product strand or to restart the machine between rolls of the product.

It is to be understood that the attaching device may advantageously comprise a clipping device such as a clipping gun and anvil. However, other attaching devices may be implemented without departing from the spirit and scope of the invention. Even twisted wire could be used to attach adjacent strands of product to each other in a concertina or other fashion. Some aspects of the invention are the ability to control the pattern of attachment, the ability to vary the pattern of attachment, and the ability to produce the product automatically with a predetermined pattern of attachment points. To this end, it is to be understood that the electronic controller may be in any one of a variety of forms including, but not limited to, a computer, a programmable logic controller (PLC), or other digital programmers (including those used in NCC applications).

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
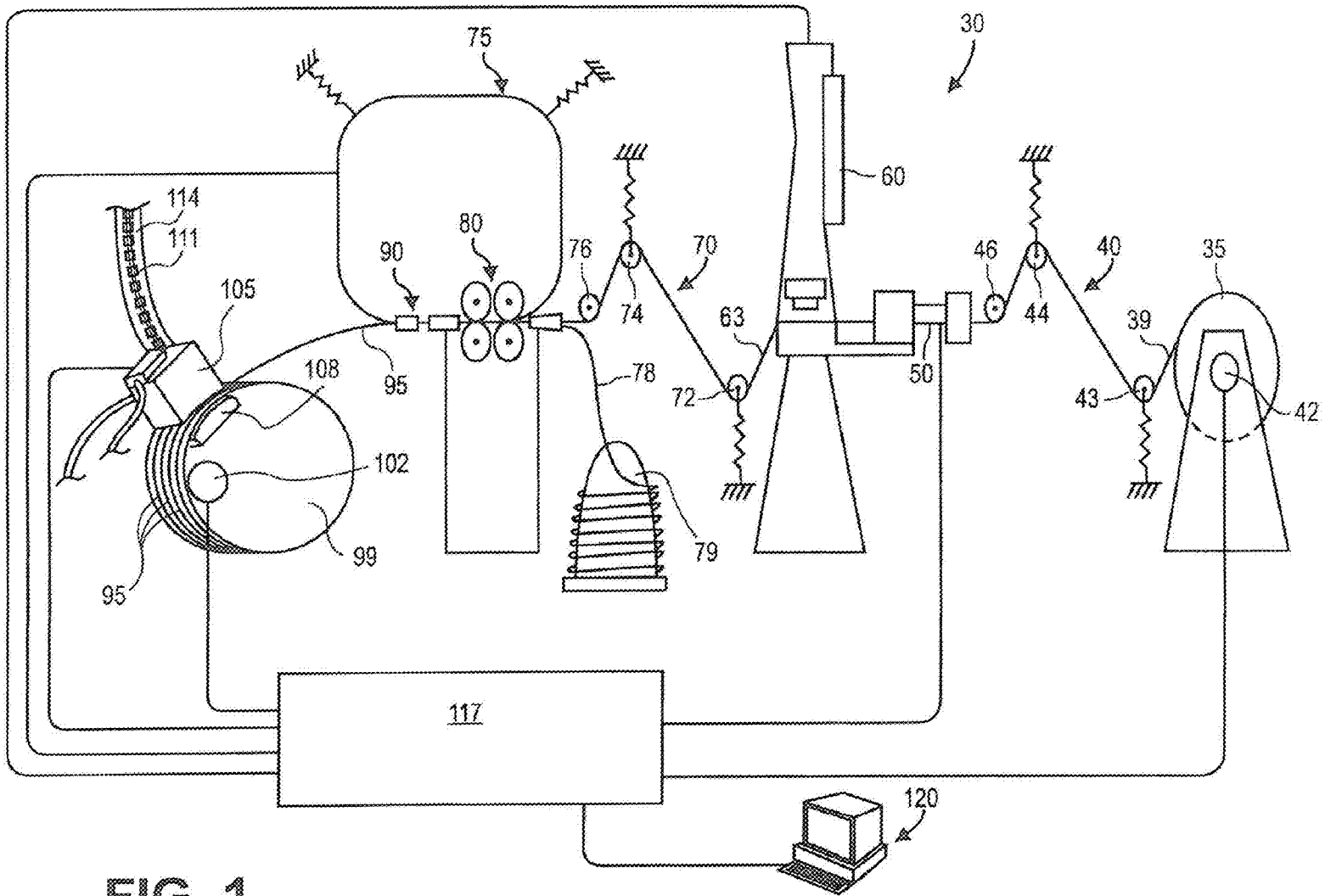
FIG. 1 is a diagrammatic view of a system in accordance with the present invention.

As discussed above, embodiments of the present invention relate to a system and method of forming a barbed tape product. For example, FIG. 1 is a diagrammatic view of a machine or system of machines 30 for forming a barbed tape concertina product in accordance with the present invention. As such, the system includes a spool 35 of tape 39 in the form a thin flat tape stock material. The spool 35 may be automatically turned by a motor 42. The tape 39 is guided through a shock absorbing portion of the system that includes guide rollers 43, 44, and 46. Then a feed device 50 moves the tape 39 into a blanking press 60. The blanking press 60 forms barbs on the tape 39. Thus, a barbed tape 63 is guided by idlers 72, 74, and 76 into a forming station 75 from a reel 79. In the forming station 75, a roll former 80 forms the barbed tape 63 at least partially around the wire 78 to form an integral barbed tape product. The barbed tape product is moved forward through the system into a radial bender 90. The radial bender 90 provides a continuous bend into the barbed tape product so that the barbed tape product is biased into coils. The coils are subsequently wound into rolls corresponding generally to the size of the coils for further processing, storage, shipping, and dispensing. Hence, as the barbed tape product leaves the radial bender 90 and the forming station 75, it does so as a radially bent single strand of barbed tape product 95.

This strand of barbed tape product 95 is received on a take up reel 99. The take up reel 99 may have a motorized product pulling paddle 102 for moving the strand of product 95 circumferentially around the take up reel 99. A clip gun 105 and an anvil 108 are disposed on radially opposite sides of product strands 95 on the take up reel 99. A string of interconnected clips 111 are fed into the clip gun 105 by a clip slip 114. The clip gun 105 is pneumatically, hydraulically, or otherwise powered to automatically and repeatedly clip adjacent strands 95 together in a predetermined pattern as will be described in greater detail below.

Advantageously, an electronic controller 117 is integrated with the system 30. The electronic controller 117 may be preprogrammed via a programming device 120. The programming device 120 may remain connected to the electronic controller or may be removed once the electronic controller 117 has been programmed. As shown in FIG. 1, the electronic controller is operatively connected to the various portions or machines within the system 30 in order to synchronize the operation of the various portions with each other. For example, the electronic controller may be operatively connected with the stock tape reel motor 42, the feed device 50, the blanking press 60, the forming station 75, the motorized paddle 102 of the take up reel 99, and the automatic clipping gun 105. Thus the system 30 can automatically form, coil, and attach adjacent loops of the product strand 95 under the control of the electronic controller 117.

Figure 2A:
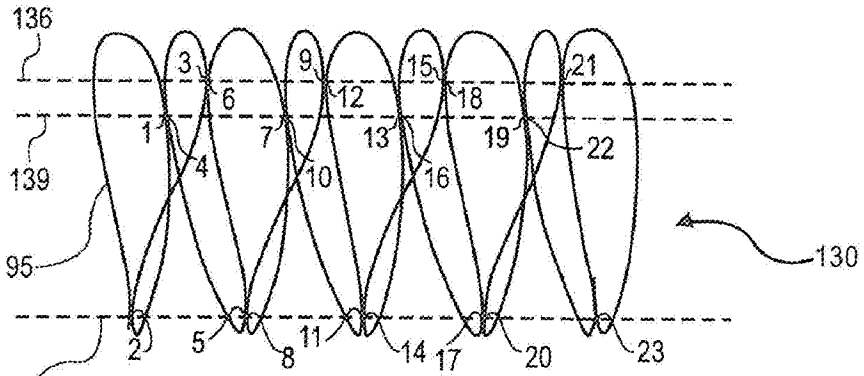
FIG. 2A is a diagrammatic side view of a segment of product having a standard concertina configuration.

FIG. 2A is a diagrammatic side view of a deployed segment 130 of barbed tape product in a standard concertina configuration. As such, attachment points are formed generally along an odd number (in this case three) of axially extending and circumferentially spaced lines 133, 136, and 139. A first axially extending line 133 is disposed near a base of a deployed segment 130 of the product. A second axially extending line 136 is disposed generally at an upper rear position on the segment 130. A third line 139 is disposed in a generally forward and upward position on the segment 130. In a standard concertina configuration, the attachment points are generally equally circumferentially spaced from each other. In order to achieve the concertina configuration, the product strand 95 is attached to adjacent strands in the helical coil of the product 130 in a predetermined manner. Specifically, the strand 95 is attached to itself at attachment points on lines 133, 136 and 139 in a helically progressive pattern as will be described below.

The segment 130 of FIG. 2A is a right-handed helix to the right. Thus, the strand 95 progresses in a clockwise direction toward the right as viewed from the left. By numbering points on the strand 95, which form part of the attachment points, in a helically progressive manner, a helically progressive pattern of attachment can be recognized. Thus, starting at a point labeled 1 in FIG. 2A and moving in a clockwise direction to the right the strand 95 reaches a second attachment point labeled 2 with a next rearwardly adjacent loop on line 133. Progressing in a clockwise direction from the point labeled 2 on the strand 95 to the point labeled 3, at which the strand 95 is connected to the next forwardly adjacent loop on line 136, starts a repeating pattern of attachment. The pattern in this case is that the strand 95 is attached to a next rear adjacent loop at a third of the distance around the circumference and then attached to a next forwardly adjacent loop after another third of the distance around the circumference. After the third of travel in a clockwise direction a forth point on the strand 95 labeled 4 forms an attachment point with the next rearwardly adjacent point, which is also labeled 1. This pattern of attachment to alternating forward adjacent and rearward adjacent portions of the strand 95 is repeated throughout the segment 130. The result is a product represented by segment 130 that can be deployed in a concertina configuration. Since the attachment points lie generally on the equally spaced lines 133, 136 and 139, and the pattern is a consistently repeated pattern, the product will naturally form a straight line configuration when deployed.

While the configuration shown in FIG. 2A may be advantageously manufactured in accordance with the present invention, and the predetermined pattern may be provided automatically under control of the electronic controller, the placement of the attachment points in FIG. 2A may be located differently as described below with regard to FIGS. 2B through 5B below.

Figure 2B:
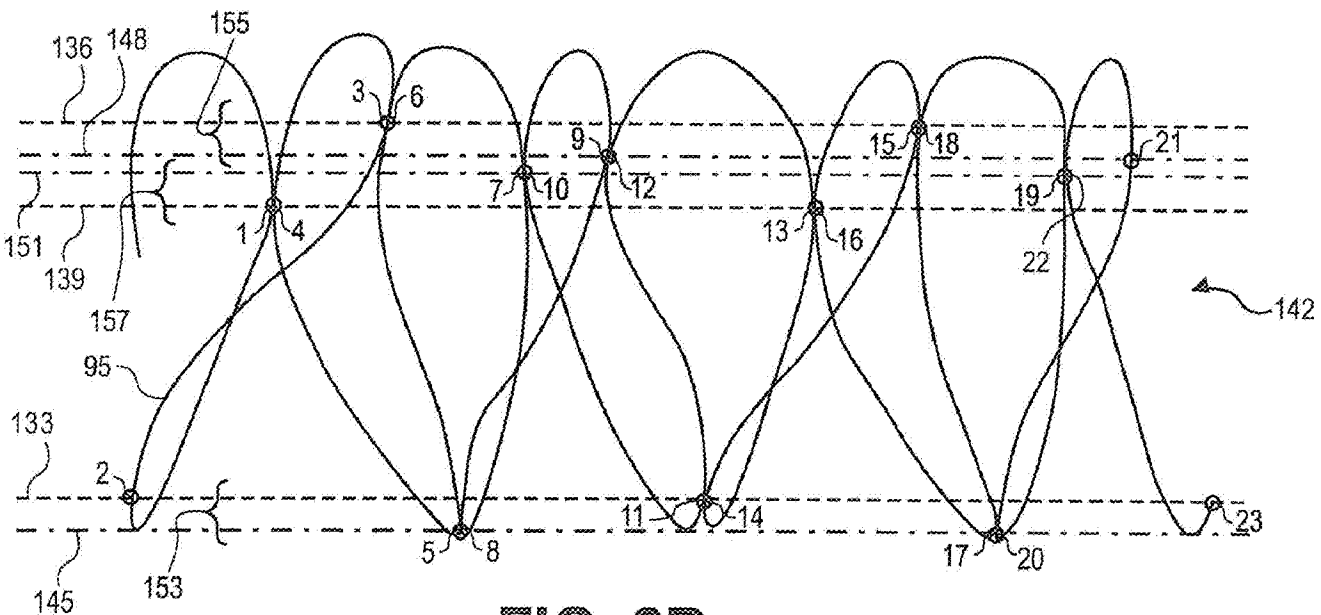
FIG. 2B is a diagrammatic side view of a modified concertina configuration in accordance with the present invention.

As shown in FIG. 2B, lines 133, 136 and 139 correspond to those shown in FIG. 2A labeled with the same numerals 133, 136, and 139. Sets of attachment points disposed generally on these lines 133, 136, and 139 are disposed generally equally spaced about the circumference of the segment. However, FIG. 2B shows a segment 142 having a different configuration of attachment points. In this case, three additional lines are defined as offset lines 145, 148 and 151. The offset lines 145, 148 and 151 are offset from lines 133, 136 and 139 by a predetermined circumferential distance. Lines 133 and 145 form a first pair of lines 153 located generally at a bottom of segment 142. Lines 136 and 148 form a second pair of lines 155 located generally at an upper rear of the segment 142. A third pair of lines 157 provide a third pair of lines 139, 151 located generally at an upper front of the segment 142.

The helical aspect of the segment 142 in FIG. 2B progresses in a clockwise direction to the right. As described with regard to FIG. 2A above, the attachment pattern progresses by the strand of product 95 being attached first to the next rearwardly adjacent loop and then to the next forwardly adjacent loop and so forth in a helically progressive manner. As shown in FIG. 2B, one full loop is formed by the product strand 95 as it progresses from a point 1 on the strand 95 to a point 4 on the strand. As may be appreciated, all of points 1 through 4 are located on lines 133, 136, and 139, which are not offset. The next coil in the helically progressive pattern is formed by the product strand as it progresses from the point 4 to the point 7 on the strand. However, it is to be noted that point 5 is located on offset line 145. Likewise, point 7 is located on offset line 151, and the second coil is just short of a completely circumferential coil of 360 degrees by the circumferential distance of the offset. A third coil is provided as the product strand 95 progresses from point 7 to point 10. As may be appreciated, the third coil is very similar in appearance to the first coil. However, each of points 7, 8, 9, and 10 are located generally on the offset lines 145, 148, and 151.

By following the same helically progressive pattern, the fourth coil transitions back to attachment points on the non-offset lines 133, 136 and 139. The result of this progressive pattern is that each subsequent attachment point on a given pair of lines 153, 155, 157 is offset relative to the attachment point immediately previous thereto on that pair. This arrangement has important manufacturing benefits. In particular, offsetting the attachment points in this manner reduces or eliminates mis-clipping by a clipping gun such as that shown in FIG. 1. This is due to the fact that the immediately previous clip on a pair of lines is not circumferentially aligned with the attachment point at which a subsequent clip is to be applied by the clipping gun.

Figure 3:
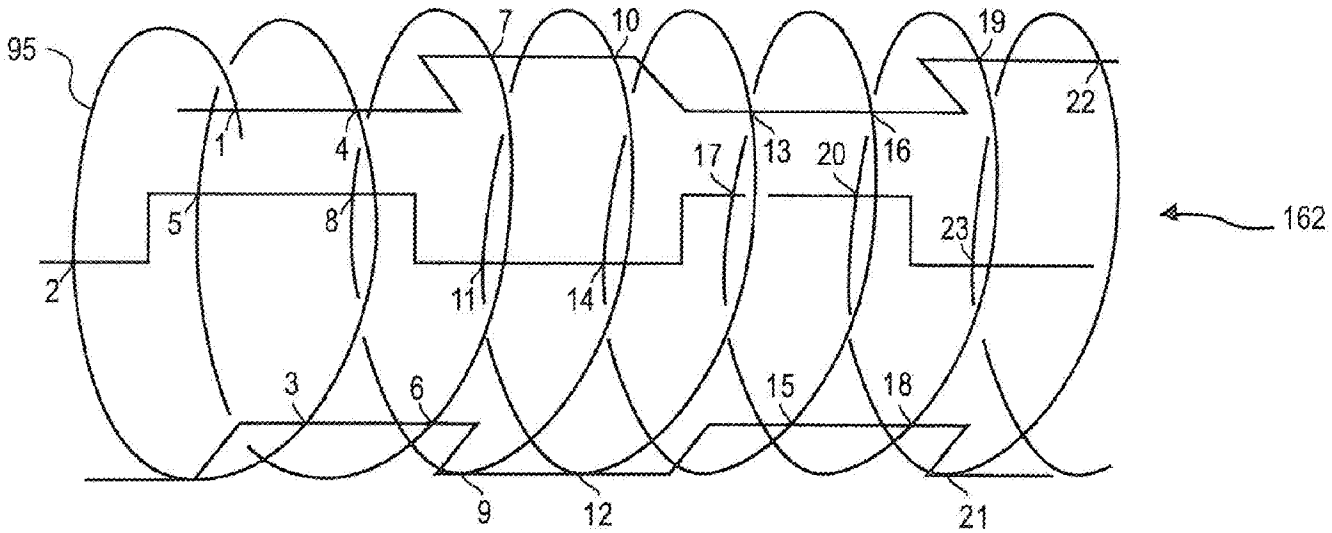
FIG. 3 is a diagrammatic perspective view of a helically coiled barbed tape product depicting attachment points required to achieve the concertina product of FIG. 2B.
Figure 4:
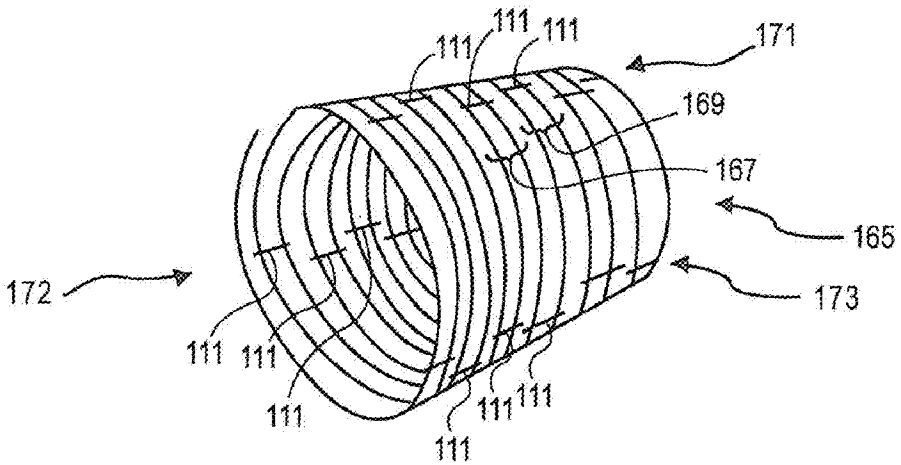
FIG. 4 is a diagrammatic perspective view of the segment of FIG. 3 in a contracted and clipped state.

FIGS. 3 and 4 provide alternative illustrations of how the offset attachment points are distributed on the segment 162, 165 in a non-deformed configuration. Segments 162 and 165 progress in counterclockwise directions to the right. However, the pattern of attachment is substantially similar to that shown and described with regard to FIG. 2B above. For example, attachment point 1 on the product strand 95 is attached to the next forwardly adjacent loop at 4 as indicated by the straight line connecting 1 and 4 in FIG. 3. Next, the strand 95 is connected to a rearwardly adjacent loop at point 2 on the strand. By following the strand helically forward to the right, it can be seen that a point 3 on the strand 95 is attached to the next forwardly adjacent loop at a point 6 on the strand. Then a point 4 on the strand 95 is connected to the next rearwardly adjacent loop at 1. Point 5 is connected to the next forwardly adjacent loop. Point 6 is attached to the next rearwardly adjacent loop. This pattern is implemented in a helically progressive pattern for a complete roll or the segment 162 thereof to provide the pattern of offsets shown by the stepped lines in FIG. 3.

FIG. 4 shows a resultant roll 165 of product in a rolled non-deployed state in accordance with the present invention. As shown, the clips 111 are circumferentially offset relative to each other from one pair of loops 167 to an adjacent pair of loops 169 in a particular circumferential region 171. As may be appreciated, the same is true for clips 111 attached to adjacent pairs of loops in each of the other circumferential regions 172 and 173 shown in FIG. 4.

Figure 5A:
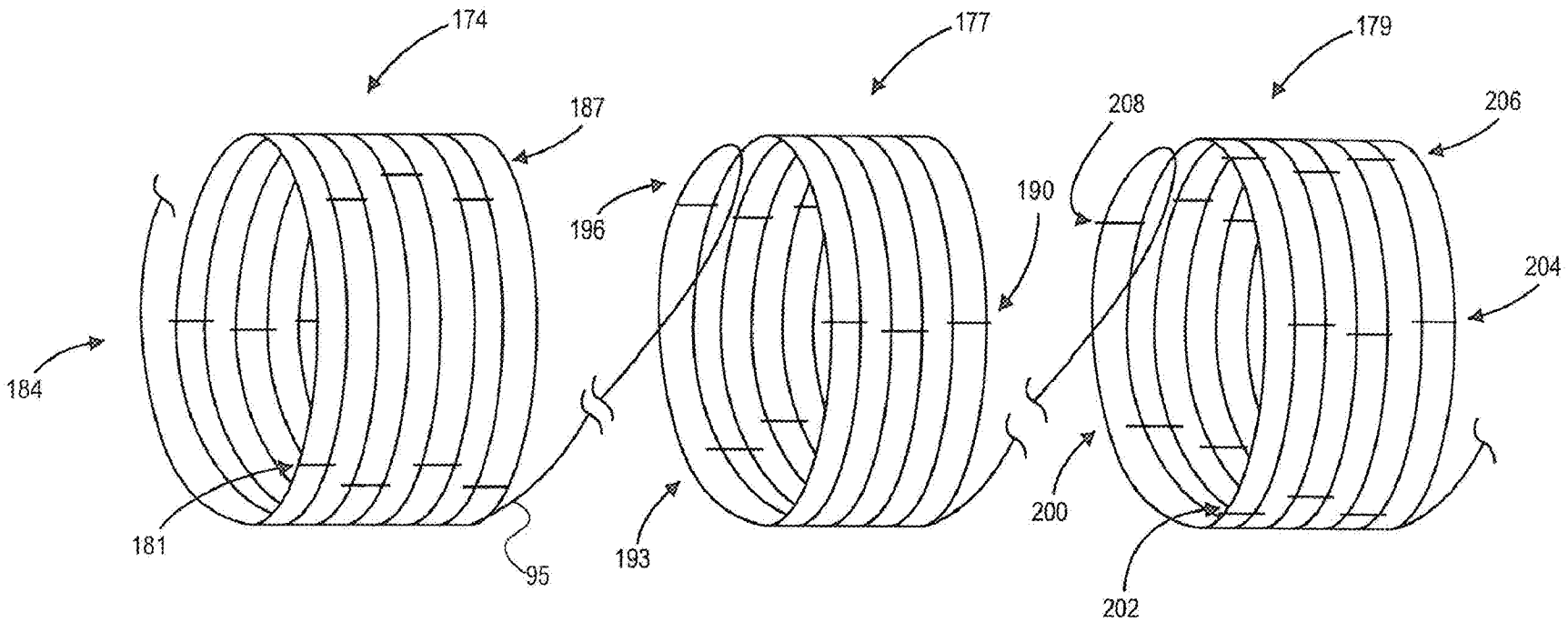
FIG. 5A is a diagrammatic perspective view showing how the pattern of attachment points can be varied from one roll to another.

FIG. 5A shows rolls of product 174, 177, and 179, which may be produced by a system of the present invention. Each of the rolls 174, 177, and 179 have a corresponding set of attachment points. The set of attachment points is programmed into the electronic controller as described previously. These rolls 174, 177, and 179 may be produced in sequence. That is, the electronic controller may be programmed to produce one roll after another with the attachment point pattern varying from one roll to the other. Alternatively, the pattern may be the same for each roll. However, the pattern may be interrupted between rolls. As shown in FIG. 5A, a length of the product strand 95 between the rolls may extend a predetermined distance without clipping by the system. The capability of the system to be preprogrammed in this manner enables continuous production without having to stop the machine for re-threading. As shown, attaching regions 181, 184, 187 may be evenly distributed circumferentially as shown on the roll 174. Regions 190, 193, and 196 may be distributed unevenly about the circumference as shown on roll 177. Any odd number of regions of attachment points may be distributed about the circumference of a roll in order to achieve a concertina configuration. For example, five regions 200, 202, 204, 206, and 208 are shown on roll 179. The number and distribution of these regions shown in FIG. 5A is exemplary only. It is to be understood that any number of regions and any variation of positions for the regions is considered to be within the spirit and scope of the present invention.

Figure 5B:
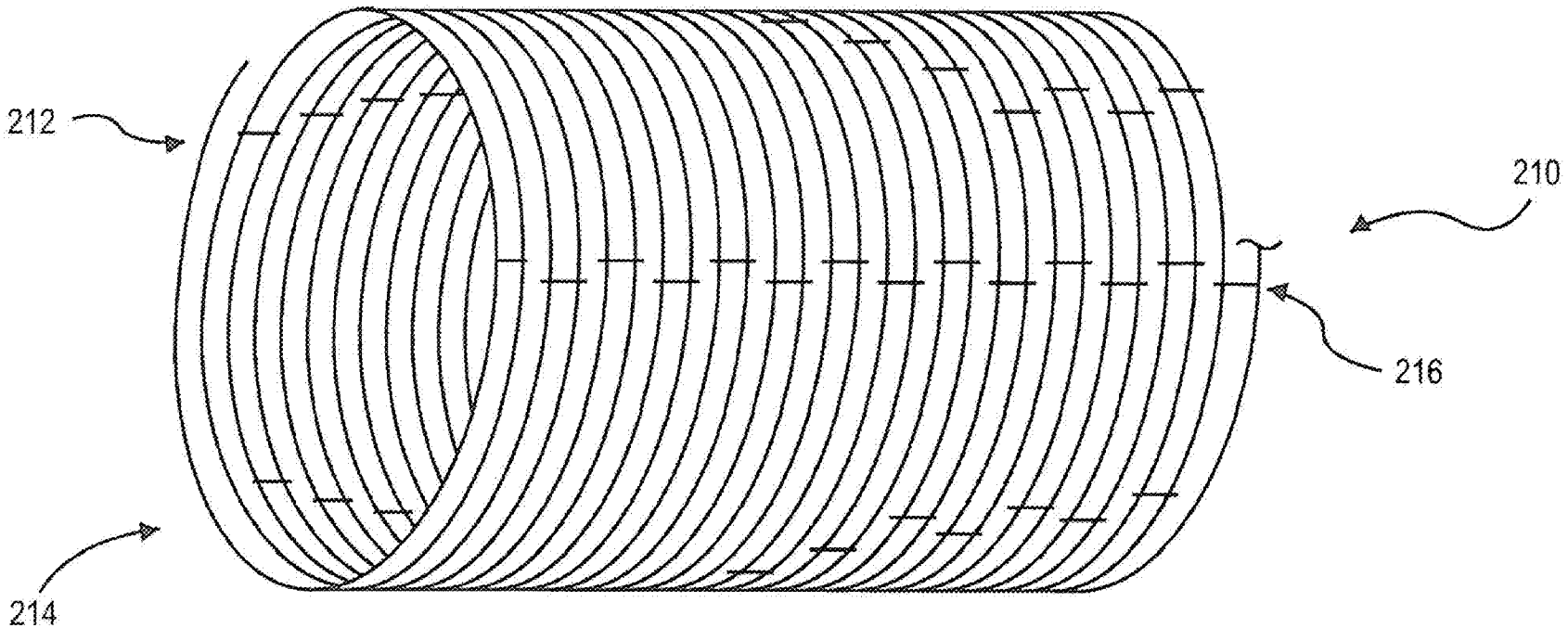
FIG. 5B is a diagrammatic perspective view showing how the pattern of attachment points can be varied within one roll.

Furthermore, as shown in FIG. 5B, the pattern of the attachment points may be varied within a given roll. For example, a roll 210 has a first region 212 and a second region 214 which progress from positions on a rear portion of the roll 210 to positions on a front of the roll in a helically progressive pattern to the right. It is to be understood, that the pattern programmed into the electronic controller and applied to a roll of product such as roll 210 determines the shape in which the product will naturally lie in a deployed state. For example, the right most portion of the roll 210 having attachment points of all 3 regions on the front of the roll 210 will tend to cause the roll to bend out of the page and to the right, as viewed, when the roll is stretched out and placed in its deployed state.

With this in mind, it is to be understood that the electronic controller can be programmed to produce rolls that will provide donut shapes in their deployed states. Alternatively, a roll may be formed that curves first in one direction, then progresses through a straight portion, and then curves in the other direction to form an "S" shape. Thus, the product could be made to form letters or even words in its deployed state. Such precision is made possible by the exactness with which the system of the present invention can be programmed to position attachment points. A more practical application for providing a precisely shaped or configured product may be that of matching the deployed product to a particular contour of a landscape or building structure. For example, product may be customized to extend in a line across the ground, then bend to extend up a wall, and bend again to extend across an edge of a roof.

Applications for such a barbed tape concertina product are endless. However, in an age when mankind no longer wishes to put up with the horrors of land minds, the capability of configuring barbed tape concertina and other barbed tape products in accordance with the present invention may prove to be a highly desirable alternative for selectively protecting large or small areas in a customizable fashion in which the product itself is a deterrent from entry into the area. Unlike land minds, the product of the present invention can advantageously be seen and avoided. On the other hand, the barbed tape concertina and other barged tape products of the present invention can be configured to slow or stop the progress of any person entering an area secured therewith.

Figure 6A:
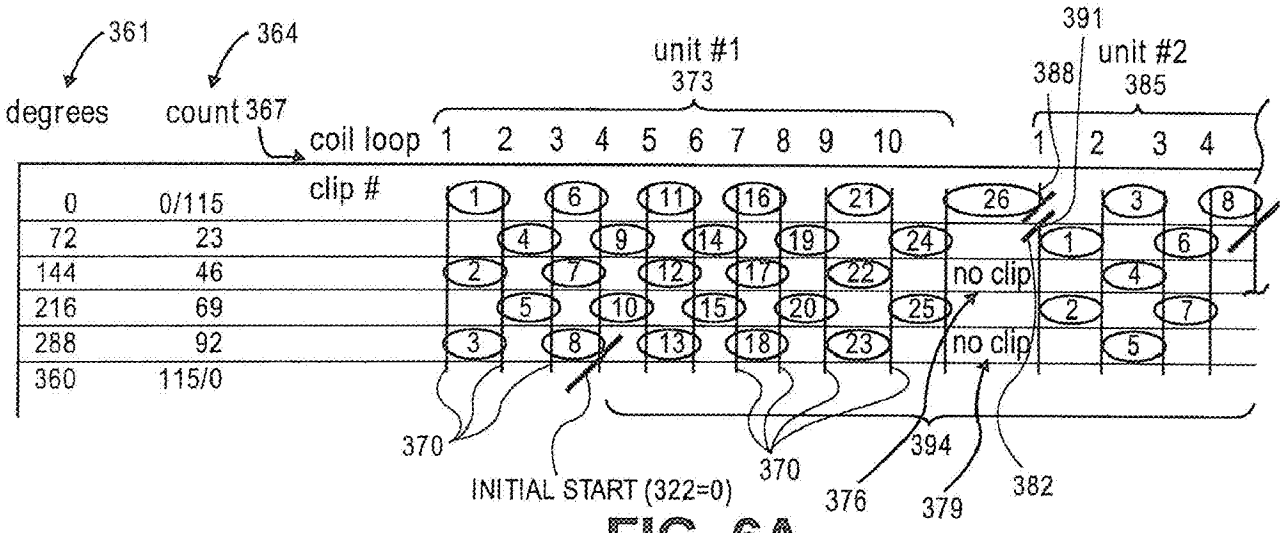
FIGS. 6A and 6B are tables of an exemplary attaching sequence in accordance with a predetermined pattern that may be programmed into an electronic controller in accordance with the present invention.
Figure 6B:
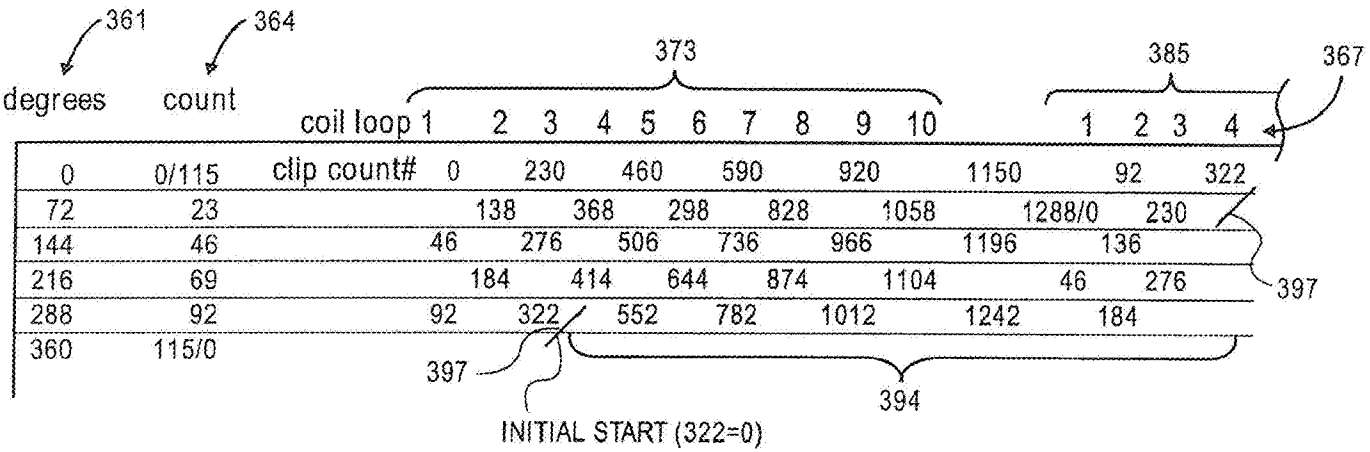

FIGS. 6A and 6B are tables showing an exemplary clipping sequence that may be programmed into the electronic controller in order to produce a barbed tape product of a particular configuration. The specific example shown in FIGS. 6A and 6B is for a ten loop coil with 5 clips per 720 degrees (pair of loops), and 26 clips total. The tables also include indications of steps for suspending clipping for a predetermined number of intervals or counts between coils, for example. An interval or "count" as used herein is defined as the distance between adjacent sets of barbs along the product strand 95. The motorized paddle 102 may register the number of intervals during which clipping is suspended as well as registering the number of intervals between clipping at the predetermined attachment points. Therefore, the motorized paddle may function as a counter and an index paddle to function as will be described below. Alternatively, a separate counter and/or index paddle may be provided.

In the table of FIG. 6A, a first column 361 indicates a position in degrees at which clips are to be attached. A second column 364 indicates a distance at which the clips are attached in terms of intervals or counts along the product strand in each coil. A first row 367 of the table indicates which loop is being clipped by sequential numbers of loops listed from left to right. The numbers in the body of the table of FIG. 6A represent clip numbers in the sequence in which they are attached. The vertical lines 370 represent the loops of a strand of product and the lines encircling each of the clip numbers and intersecting pairs of loops represent attachment of the clips to respective loops of the strand. Thus, as shown in FIG. 6A, clips 1 through 3 attach the first loop to the second loop. It is to be noted that the first clip is attached at a position designated at zero degrees and zero counts. In the particular sequence illustrated in FIGS. 6A and 6B, the sixth clip will also be located at zero degrees. However, when the sixth clip is attached, 115 intervals or counts of the strand will have passed through the clipping device subsequent to attachment of the first clip. As shown, the sequence of clipping proceeds in a helically progressive pattern as described above, with sequential clips being attached every 144 degrees until a coil or unit 373 has been completed.

At the end of the coil or unit 373, the system skips attaching two sequential clips as indicated at 376 and 379. Then the machine is stopped and the strand of product is cut off at a position corresponding to break lines 382. With the machine stopped, the coil or unit 373 is pushed off the take up reel, a counter is reset, and the machine is started again. The steps of cutting off, pushing off, and resetting the counter each require an additional time. Accordingly, a separate "delta t" is programmed or otherwise implemented in the electronic controller to provide time for each of these steps between coils. No stopping is required along the strand at the positions where clipping is skipped so a cumulative "delta t" need not be large. Furthermore, a segment of approximately eight counts may be provided in which the strand is cut. The segment may be greater or less than eight counts, but provides a length of product that enables separating of adjacent loops therefrom in order to insert a clipping tool. The segment may be ten or more counts, or may be as few as two to four counts. The segment shown in FIG. 6A is twenty-three counts long and aligns the attachment points of the first unit 373 with the attachment points of a second unit 385 for ease of illustration. The segment extends between clip number 26 (the last clip of the first unit 373) and clip number 1 of the second coil or unit 385. The cut will generally be made in a central portion of the segment leaving tails forming free ends 388 and 391 extending from respective clip numbers 26 and 1. Any number of clippings may be skipped and any length of segment for cutting the strand may be provided under electronic control. However, as shown, skipping attachment of at least two clips permits a clean break between the units 373 and 385 by a single cut.

Advantageously, the starting and ending point for a cycle 394, generally corresponding in length to a length of strand for a coil or unit 373, may be selected so as not to correspond to the cut off point. For example, a starting and ending point for the cycle 394 shown in FIGS. 6A and 6B is at clip number 9. In this way several loops of product strand are on the take up reel and threaded in the clipping device when the strand is cut between coils or units 373 and 385. At least a portion of these several loops remains threaded in the clipping device and is fed onto the take up reel during and after cutting. Therefore, refeeding and rethreading the strand for each roll or unit 373, 375 is not required. Furthermore, an index of the strand is preserved since the counter or index paddle is continuously engaged. On the other hand, if the starting and ending point is made to correspond to the cut off point, then the strand would have to be rethreaded through the clipping device and refed onto the take up reel and index paddle. Such rethreading and refeeding requires down time for the machine and reduces efficiency. Furthermore, continuous operation is difficult if not impossible with such rethreading and refeeding requirements. On the other hand, the clipping sequences of the present invention have the capability of preserving the index, permitting the steps of cut off, push off, and resetting the counter while remaining under the control of the electronic controller. It is contemplated that the cut off may be effectuated by the clipping machine. Alternatively, a separate machine could perform the cut off step. Further alternatively, a human operator could manually clip during a time interval provided by the electronic controller.

FIG. 6B is a table similar to the table of FIG. 6A. However, the table of FIG. 6B has the number of counts or intervals for a given coil at respective attachment points for units 373 and 385 indicated in the body of the table instead of the clip numbers. Thus, a running count for a coil or unit goes from zero up to 1,288, after which the counter is reset to zero again. On the other hand, the electronic controller is set to a starting point for the cycle 394 when the count reaches 322 as indicated by a slash 397. Thus, the cut off and associated steps may be advantageously implemented at an intermediate point in the cycle 394 as described above.

While the tables of FIGS. 6A and 6B show the clips sequentially attached at evenly spaced increments along the strand, it is to be understood that the attachment points can be varied to advantageously provide the offset of the clips from one pair of loops to another as has been described with respect to FIGS. 2A-5D above. This may be implemented with clipping and cut off sequences similar to those of FIGS. 6A and 6B. For example, instead of clipping after each subsequent 46 counts, the clipping sequence may implement clipping at alternating intervals of 45 and 47 counts to achieve the advantages of offsetting the clips along axial lines of a coil in addition to the advantages of the clipping and cut off sequences shown and described with regard to FIGS. 6A and 6B.

Figure 7A:
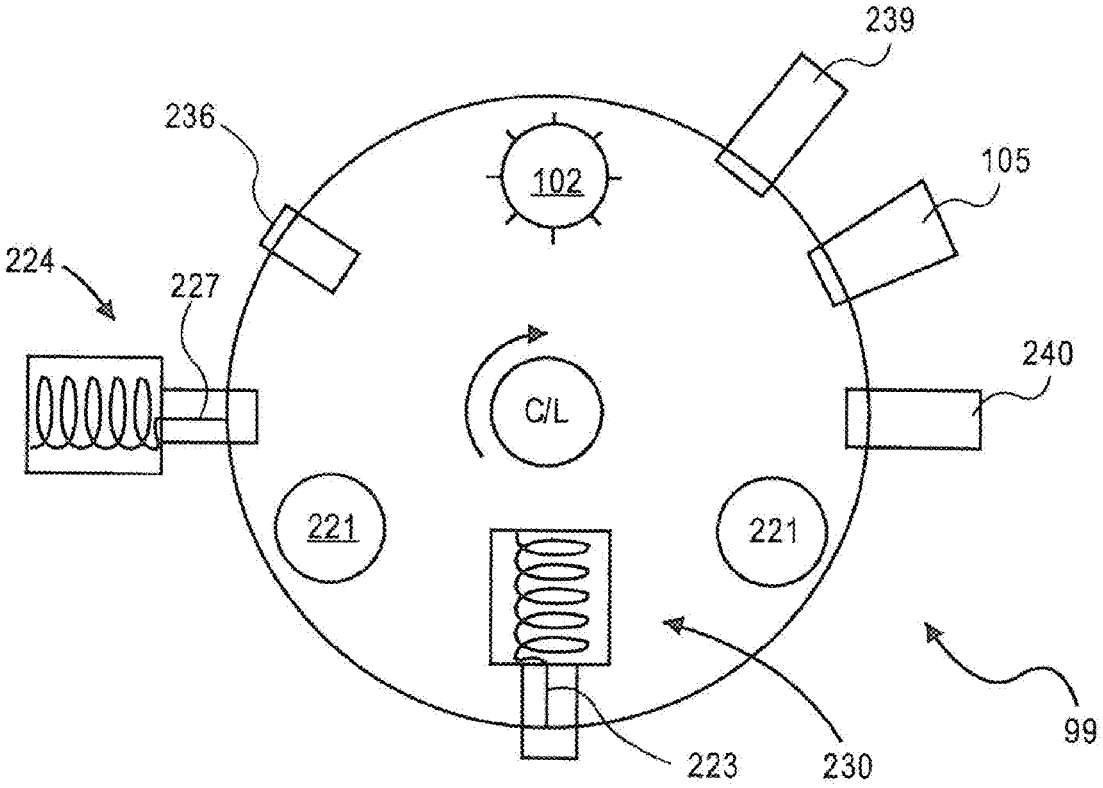
FIG. 7A is a diagrammatic view of the take up reel showing several devices supported thereon.

FIG. 7A is a diagrammatic view of the take up reel 99 with a variety of devices that may be supported thereon for attaching objects to the barbed tape product of the present invention. Element 105 represents the clipping device 105 shown in FIG. 1 and described above. Element 102 represents the motorized paddle 102 or index paddle described above. The take up reel 99 may further have rollers 221 for aiding smooth rotation of the reel 99. A line attaching device 224 may be provided for attaching a line to the product at predetermined positions under software control. The line attaching device may attach a spacer line 227 to limit separation of selected ones of the loops from each other in the deployed state. A plurality of line attaching devices may be supported on the reel at predetermined circumferential positions around the coil of the product to form a generally uniform separation of all sides of the coil when it is deployed. Alternatively, different spacing lengths of the spacer line 227 may be provided at different positions on the coil to provide a predetermined configuration of the coil in its deployed state.

Other devices may be selectively provided on the take up reel including a sensor line attaching device 230 that may be supported at a generally radially inward position on the reel for attaching a sensor or other line 233 generally on an inside of the product strand. The other line 233 or the spacer line 227 may be one of a plurality of such lines that may include spacer lines, trip lines, and/or sensor lines. It is to be understood that the sensor lines may be of any type, including but not limited to magnetic or fiber optic lines. All of these lines may incorporate any suitable material including, but not limited to, metal, plastic, or composites formed as wires, tapes, ribbons, cables, or ropes, for example. The reel 99 may also have a tab inserting device 236 supported thereon for attaching tabs or flags to the strand of product at predetermined positions.

As has been described above with regard to the attachment elements, the spacer lines, trip lines, sensor lines, and tabs may be attached at any predetermined positions on the product strand. Furthermore, it is to be understood that these positions may be varied within a roll or unit 373, 385 of the product, or may be varied from one roll to another. As shown, a cut off device 239 may be provided separately from the attaching device for cutting the product at a predetermined position. Alternatively, the cut off device may be provided integrally with the attaching device 105. Furthermore, it is to be understood that one or more of the line attaching devices 224, 230 could be provided integrally with the attaching device 105. In fact, any number of the attaching device 105 and the other devices may be integrated together as attachment mechanisms of an overall device or may be provided separately without departing from the spirit and scope of the invention. It is also to be understood that any number of additional devices such as auxiliary device 240 may be provided on the take up reel to treat the strands of product or attach additional objects in any manner desired to provide a variety of functions to the product. For example, motion sensors or microphones could be attached to the product at selected locations.

Figure 7B:
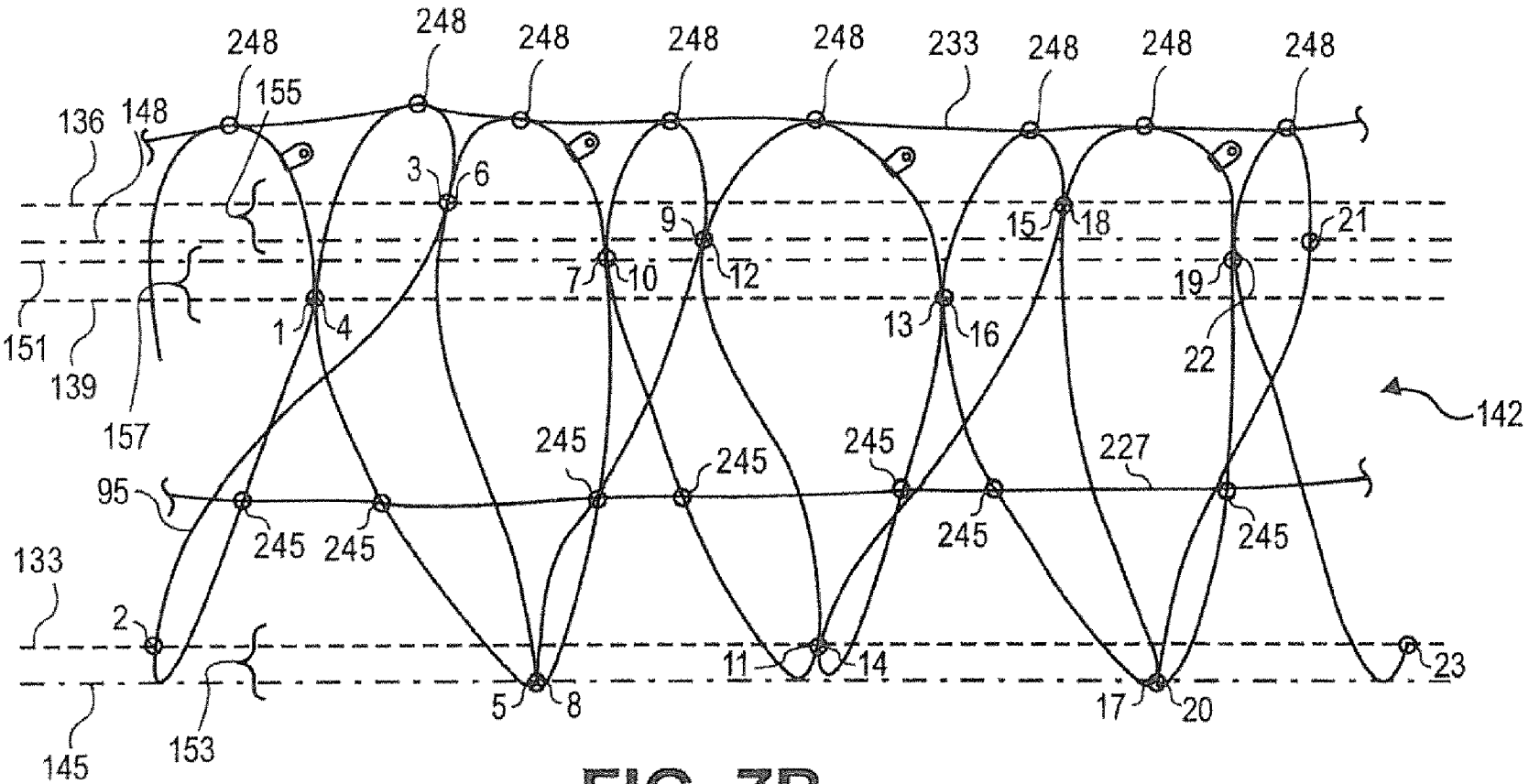
FIG. 7B is a perspective view of a non-concertina barbed tape product having objects attached at various circumferential positions in accordance with the method and system of the present invention.

FIG. 7B is a perspective view of a segment of barbed tape product 242 having an exemplary spacer line 227 attached to an exterior of the coil by line attachment elements 245. These line attachment elements may be the same as those described above and in the co-pending U.S. application Ser. No. 10/959,531, entitled "BARBED TAPE PRODUCT WITH A PREDETERMINED PATTERN OF ATTACHMENT POINTS AND ATTACHMENT ELEMENTS", filed Oct. 5, 2004 by the same applicant, the disclosure of which is incorporated herein by reference. Alternatively, they may be attachment elements configured specifically for attaching lines. The attachment elements may function to both attach adjacent loops of the product together and/or to attach separate objects, including the spacer lines 227. FIG. 7B also shows the sensor line 233 held on an interior of the coil by attachment elements 248. As may be appreciated, the lines 227 and 233 may function as trip lines because they will cause the product to close in upon any intruder that engages the lines 227, 233. While shown in a relatively loose relation similar to hog rings in FIG. 7B, the attachment elements 245, 248 may form a tight crimp on the product 242 in order to hold the lines or other objects at the predetermined positions. Furthermore, the lines 227, 230 may be fastened by other mechanisms including by structural elements integral with the lines 227, 230 themselves, for example. Still further, the line attachment devices 224, 230 may take a form other than that of clipping guns. Axially adjacent attachment elements among each of elements 245 and 248 may be circumferentially offset relative to each other to facilitate automatic attachment under control of the electronic controller. Furthermore, FIG. 7B is exemplary only. It is expected that two to four spacer lines may also be attached to the product for holding the product in a uniformly distributed position in the deployed state. Also, tabs or flags 251 may be attached to the product at predetermined intervals or selected positions.

The attachment of objects including spacer wires shown and described with regard to FIGS. 7A and 7B may be applied to concertina. A method of making a barbed tape concertina product, for example, may include attaching the spacer line at a position of every fifth clip. That is the electronic controller could be configured to attach the spacer line 227 and then skip four clips and attach the spacer line 227 at the fifth clip.

Furthermore, the concertina product formed with spacer lines 227 has the advantage of enabling a method of deploying that is very fast and simple in accordance with the disclosure of U.S. patent application Ser. No. 10/959,530, entitled CONCERTINA TAPE PRODUCTS CONFIGURED FOR STABLE DEPLOYMENT AND RETRIEVAL, by the same inventor, filed Oct. 5, 2004, and U.S. Provisional Patent Application Ser. No. 60/589,668, entitled RAPID DEPLOYMENT BARBED TAPE AND DISPENSER, by the same inventor, filed Jul. 19, 2004, each of which is incorporated herein by reference. This method may entail fixing a first end of a roll on the ground or other structure to be protected. Then a truck or other vehicle carrying the rest of the roll may be driven along a path in which the product 242 is to be deployed. A slight tension may be applied to the roll so that the product pays out at the same rate the vehicle moves away from the first end of the product until the roll is completely expanded into its deployed state. Multiple rolls may be connected together and payed out in this manner. The rolls of the non-concertina product formed in the manner described above have a helical configuration, even in the expanded deployed state. Therefore, collection of the product may be advantageously accomplished by an auger that turns and pulls the product into a collection bin. As may be appreciated, such an auger provides great collection advantages since the product is otherwise difficult to handle and especially difficult to collect. Automation of such an auger has additional advantages of increased speed and power in collecting the barbed tape product 242.

Thus, it can be seen that the present system and method associated therewith provide advantages over past systems and methods. It is to be understood that the system may include additional machines or elements without departing from the spirit and scope of the present invention. Likewise, some of the devices of the system may be omitted without departing from the scope of the invention. For example, a barbed tape concertina or other barbed tape product may be formed of a tape without the reinforcing wire shown and described with regard to FIG. 1. In such cases, providing attachment points by an automatic clipping gun and operating the system under control of an electronic controller can still be advantageously implemented. The system and method of the present invention is not dependant on the materials used to form the product. Rather, forming the product of any materials is considered to be within the spirit and scope of the present invention. Furthermore, the order of the steps of the present method may be changed without departing from the spirit and scope of the invention. For example, clipping need not occur in a helically progressive order to provide a helically progressive pattern in a finished barbed tape concertina product. In this regard, it is possible that several adjacent loops could be clipped in a first attachment region before loops in a second attachment region circumferentially spaced from the first region without departing from the spirit and scope of the present invention. Furthermore, this non-helically progressive order may be applied to other barbed tape products that are not concertina products. Still further, it is to be understood that while the distances of the offsets described herein may have ideal magnitudes, the present invention is not intended to be limited to offsets of a particular distance. Rather, the present invention is considered to encompass any and all circumferential offsets, including offset distances that approach zero.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, clips may be provided as a bunch of loose individual clips. Such individual clips may be acquired in barrels and dispensed into a special bowl in the system. The bowl, in turn, delivers the clips into a clip gun for automatic clipping in accordance with the present invention.

The invention claimed is:

1. A machine for automatically making a barbed tape product, the machine comprising an electronic controller operatively connected to an attachment device in the machine for automatically attaching at least one object to the barbed tape product in at least one predetermined position on the barbed tape product under electronic control to form a roll of the barbed tape product, wherein the attachment device and electronic controller are configured to variably attach the at least one object to the barbed tape product at a predetermined attachment point corresponding to the predetermined position under electronic control.

2. The machine for automatically making barbed tape product of claim 1, further comprising:

a roll former;

a radial bender;

a take up device;

wherein the electronic controller is operatively connected to the roll former, the radial bender, and the take up device to form the roll of the barbed tape product.

3. The machine for automatically making barbed tape of claim 1, wherein the machine is configured to attach a plurality of objects including the at least one object to the barbed tape product.

4. The machine for automatically making barbed tape of claim 3, wherein the electronic controller is configured to provide:

a first set of the attachment points for the plurality of objects in a predetermined first pattern for a first roll of the product; and a second set of the attachment points for the plurality of objects in a predetermined second pattern for a second roll of the product;

wherein the patterns are varied from the first set to the second set.

5. The machine for automatically making barbed tape of claim 3, wherein the plurality of objects comprises a plurality of dissimilar objects and the attachment device has a plurality of mechanisms configured for respectively attaching the plurality of dissimilar objects.

6. The machine for automatically making barbed tape of claim 3, wherein the plurality of objects comprises a plurality of similar objects and the attachment device has a plurality of attachment mechanisms configured for respectively attaching the plurality of similar objects.

7. The machine for automatically making barbed tape of claim 3, wherein the electronic controller is configured to provide a first set of attachment points for a first attachment mechanism of the attachment device and a second set of attachment points for a second attachment mechanism of the attachment device.

8. The machine for automatically making barbed tape of claim 3, wherein the attachment device is a first attachment device, the machine further comprising at least a second attachment device configured for attaching respective first and second objects of the plurality of objects.

9. The machine for automatically making barbed tape of claim 8, wherein the objects are dissimilar objects and the first and second attachment devices are dissimilar devices configured for attaching the respective first and second dissimilar objects.

10. The machine for automatically making barbed tape of claim 8, wherein the objects are similar objects and the first and second attachment devices are similar devices configured for attaching the respective first and second similar objects to the barbed tape product.

11. The machine for automatically making barbed tape of claim 8, wherein the electronic controller is configured to provide a first set of attachment points for the first attachment device and second set of attachment points for the second attachment device.

12. The machine for automatically making barbed tape of claim 3, wherein the electronic controller is configured to provide:

a set of the attachment points for attaching the plurality of objects in a predetermined pattern for a roll of the product; and a variation of the pattern within the roll.

* * * * *